US007140158B2

(12) United States Patent
Steadman

(10) Patent No.: US 7,140,158 B2
(45) Date of Patent: Nov. 28, 2006

(54) COMPOSITE BEAM

(76) Inventor: William Steadman, 7858 Meadow Lark La., Port Saint Lucie, FL (US) 34952

( * ) Notice: Subject to any disclaimer, the term of this patent is extended or adjusted under 35 U.S.C. 154(b) by 55 days.

(21) Appl. No.: 10/885,932

(22) Filed: Jul. 6, 2004

(65) Prior Publication Data

US 2006/0005508 A1 Jan. 12, 2006

(51) Int. Cl.
*E04C 3/02* (2006.01)

(52) U.S. Cl. ..... 52/694; 52/740.8; 52/730.1

(58) Field of Classification Search ..... 52/720.1, 52/726.1, 730.1, 730.3, 740, 740.8, 415–421, 52/424–425, 427, 429, 432–435, 437–442, 52/633, 638, 650.1, 653.1, 690–694
See application file for complete search history.

(56) References Cited

U.S. PATENT DOCUMENTS

| | | | | | |
|---|---|---|---|---|---|
| 409,832 | A | | 8/1889 | Drake | |
| 1,197,363 | A | * | 9/1916 | Francis | 52/433 |
| 1,918,346 | A | * | 7/1933 | McHose | 52/740.8 |
| 2,826,521 | A | | 3/1958 | Robinson | |
| 2,847,733 | A | | 8/1958 | Roy | |
| 3,164,891 | A | * | 1/1965 | Gier, Jr. | 29/890.03 |
| 3,179,983 | A | | 4/1965 | Webber et al. | |
| 3,530,631 | A | * | 9/1970 | Guddal | 52/414 |
| 4,065,903 | A | | 1/1978 | Morley | |
| 4,191,000 | A | * | 3/1980 | Henderson | 52/729.4 |
| 4,236,364 | A | * | 12/1980 | Larsson et al. | 52/383 |
| 4,336,678 | A | * | 6/1982 | Peters | 52/729.4 |
| 4,418,463 | A | * | 12/1983 | McNeill | 29/527.4 |
| 4,475,328 | A | * | 10/1984 | Reeder et al. | 52/693 |
| 4,615,163 | A | | 10/1986 | Curtis et al. | |
| 4,748,786 | A | * | 6/1988 | Hannah | 52/694 |
| 4,888,934 | A | * | 12/1989 | Couture | 52/793.11 |
| 5,048,256 | A | * | 9/1991 | Thorsnes | 52/730.7 |
| 5,317,947 | A | * | 6/1994 | Miyata | 84/615 |
| 5,440,845 | A | | 8/1995 | Tadros et al. | |
| 5,644,888 | A | * | 7/1997 | Johnson | 52/651.01 |
| 5,809,722 | A | | 9/1998 | Bertsche | |
| 5,865,929 | A | * | 2/1999 | Sing | 156/264 |
| 6,173,550 | B1 | * | 1/2001 | Tingley | 52/729.1 |
| 6,318,046 | B1 | * | 11/2001 | Horsfield et al. | 52/730.7 |
| 6,511,567 | B1 | | 1/2003 | Ruggie et al. | |
| 2003/0182891 | A1 | | 10/2003 | Reichartz | |
| 2006/0137282 | A1 | * | 6/2006 | Anvick et al. | 52/649.1 |

FOREIGN PATENT DOCUMENTS

| | | | |
|---|---|---|---|
| FR | 2568613 | A * | 2/1986 |
| GB | 2062077 | | 5/1981 |
| JP | 06272351 | | 9/1994 |
| WO | WO 8202916 | A1 * | 9/1982 |
| WO | WO8504207 | A1 * | 9/1985 |
| WO | WO 9606994 | A1 * | 3/1996 |

* cited by examiner

*Primary Examiner*—Jeanette Chapman
(74) *Attorney, Agent, or Firm*—Tarolli, Sundheim, Covell & Tummino LLP

(57) ABSTRACT

A composite beam is disclosed. The component has spaced pairs of elongate wood members, the members of each pair being in face to face mating orientation. A generally sinuous shaped spacer rod sub assembly having spacer portions connected at junctures is provided. The elongate member pairs each having mating faces including recesses contoured to receive one of the junctures and parts of connected spacer portions. The connected spacer portions each project angularly in opposed directions from their associated juncture and its recess in one of the pairs toward the other pair of members. Each of the junctures is disposed in an associated recess in the members whereby to provide a composite beam having the pairs of elongate members maintained in spaced relationship by the rod subassembly.

32 Claims, 4 Drawing Sheets

COMPOSITE BEAM

The present invention relates to building components and more particularly to a composite beams of steel reinforced wood.

BACKGROUND

Joists and trusses in frame buildings historically have been made from solid wood beams. Depending on the size of a building and anticipated loads to be supported, such beams are nominally two inches thick and six, eight or ten inches or more in width.

In many parts of the world timber suitable for making such beams and trusses is simply not available. In those parts of the world where timber is plentiful, it is often difficult to obtain good quality seasoned wood free of warping.

There have been proposals for composites to serve as beams and trusses. Such composites are more resistant to warping than solid wood beams. In addition such composites if properly designed and construct have greater strength per unit of weight at least as compared with the wood varieties used in construction.

While it is esthetically desirable for a composite beam or truss to appear to be all wood, prior proposals for composites have failed to so appear, at least in beams and trusses that can be made economically. Moreover prior proposals have typically been lacking in terms of strength per unit of weight.

Accordingly it would be desirable to provide a composite beam or truss that can be fabricated economically from wood pieces of relatively small cross sectional area strengthened by reenforcing rods, preferably of steel and, a method of making such composites.

SUMMARY OF THE DISCLOSURE

The composite beam of the preferred embodiment includes spaced pairs of elongate members in face to face relationship. A pair of straight reenforcing rods are provided. Each rod is associated with one of the pairs of elongate members and positioned in a groove in one of the members such that each straight rod is adjacent the other of the members of the associated pair.

A generally sinuous reenforcing rod element is provided. The element includes oppositely sloping sections connected by curved junctures. Alternate junctures are disposed in associated contoured grooves in the other member of the one pair. The alternate junctures are also attached to the straight rod associated with the one pair of members.

The remaining junctures are attached to the straight rod associated with the other pair of members. The remaining junctures are also disposed in contoured grooves in the other member of the other pair. Preferably, a router is used to form the contoured grooves.

Panels of wood are disposed on opposite sides of the reenforcements and between the members such that the panels and the members perimetrically encase the rods. End pieces of wood between the members complete a wood exterior completely hiding the reinforcing rods.

DRAWING DESCRIPTION

Figure 3B:
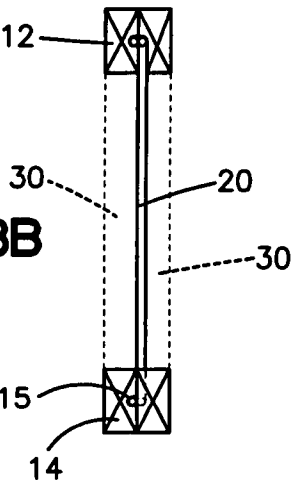
FIG. 3A is a sectional view of the beam of FIG. 2 as seen from the plane indicated by the line 3—3 of FIG. 2.
Figure 3A:
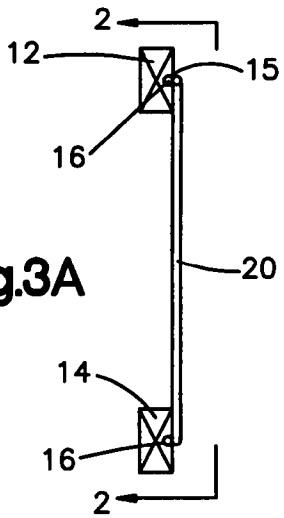
Figure 4:
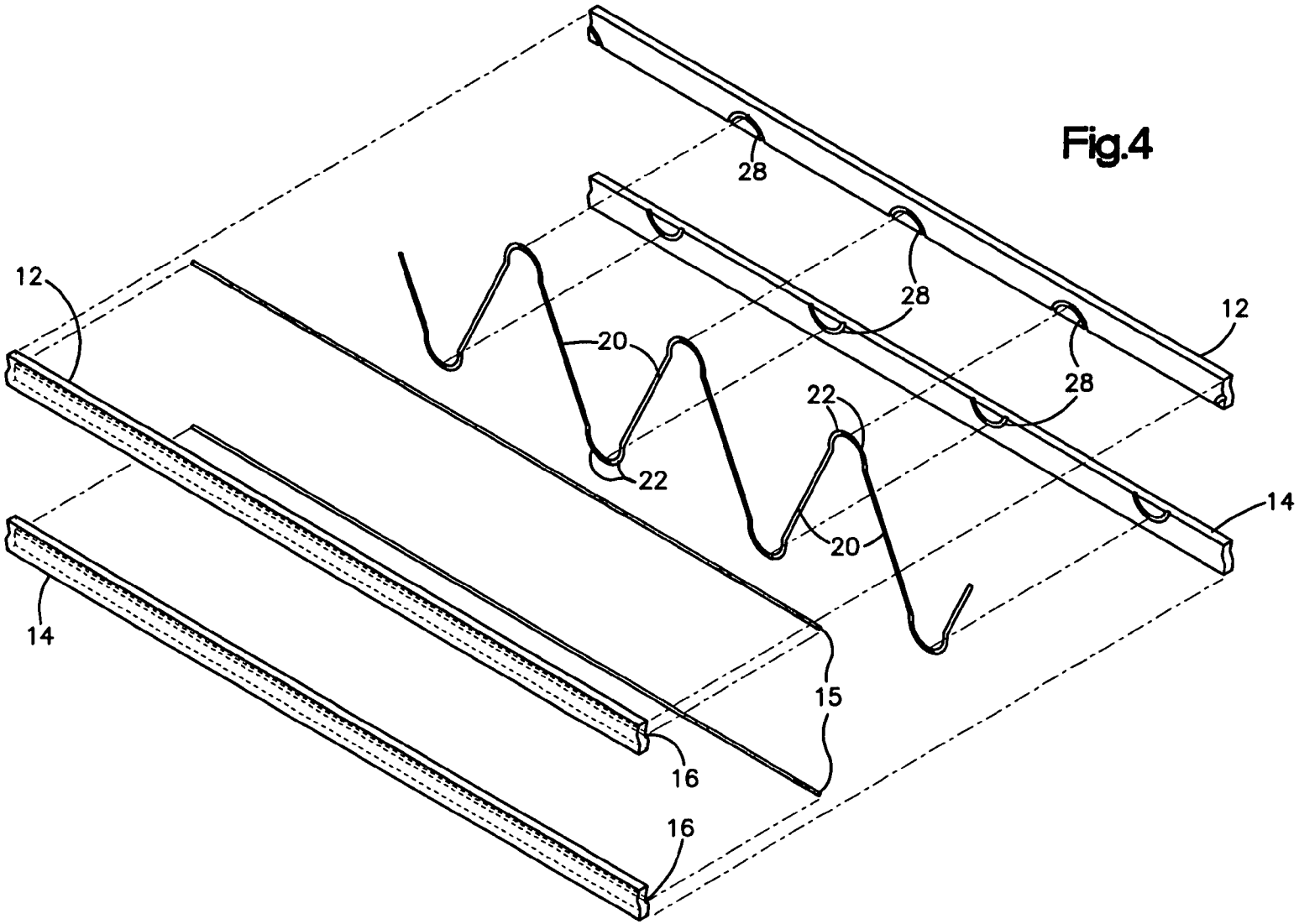
Figure 5:
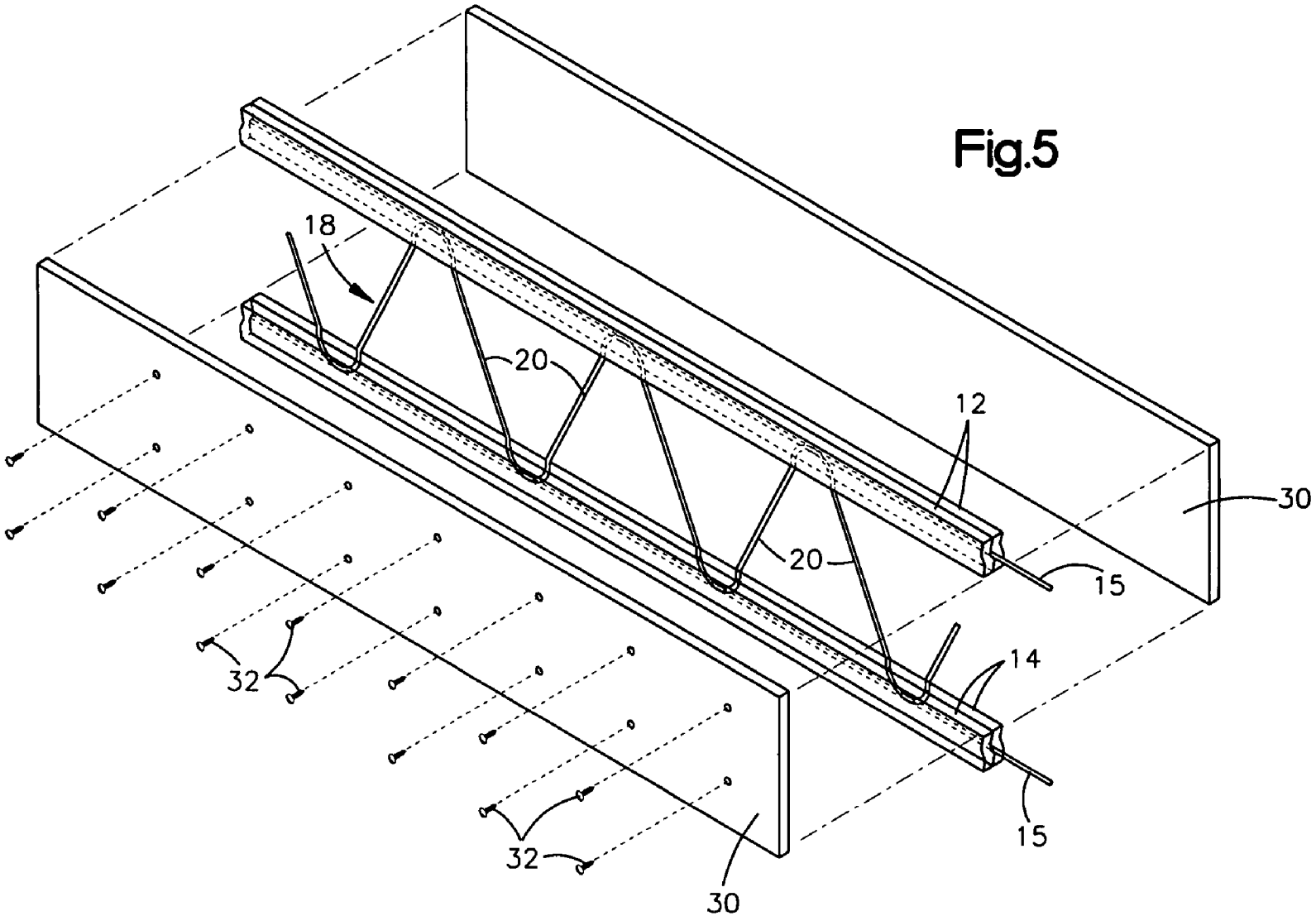

FIG. 3 B is a view corresponding to FIG. 3A with upper and lower elongate members added to encase the elongate rods and junctures of the sinuous rod;

FIG. 4 is an exploded view of the rod and elongate member components of a beam section; and, FIG. 5 is an exploded view of a core section assembled from the components of FIG. 4 and side panels to be added to the assembled section.

DETAILED DESCRIPTION

Figure 1:
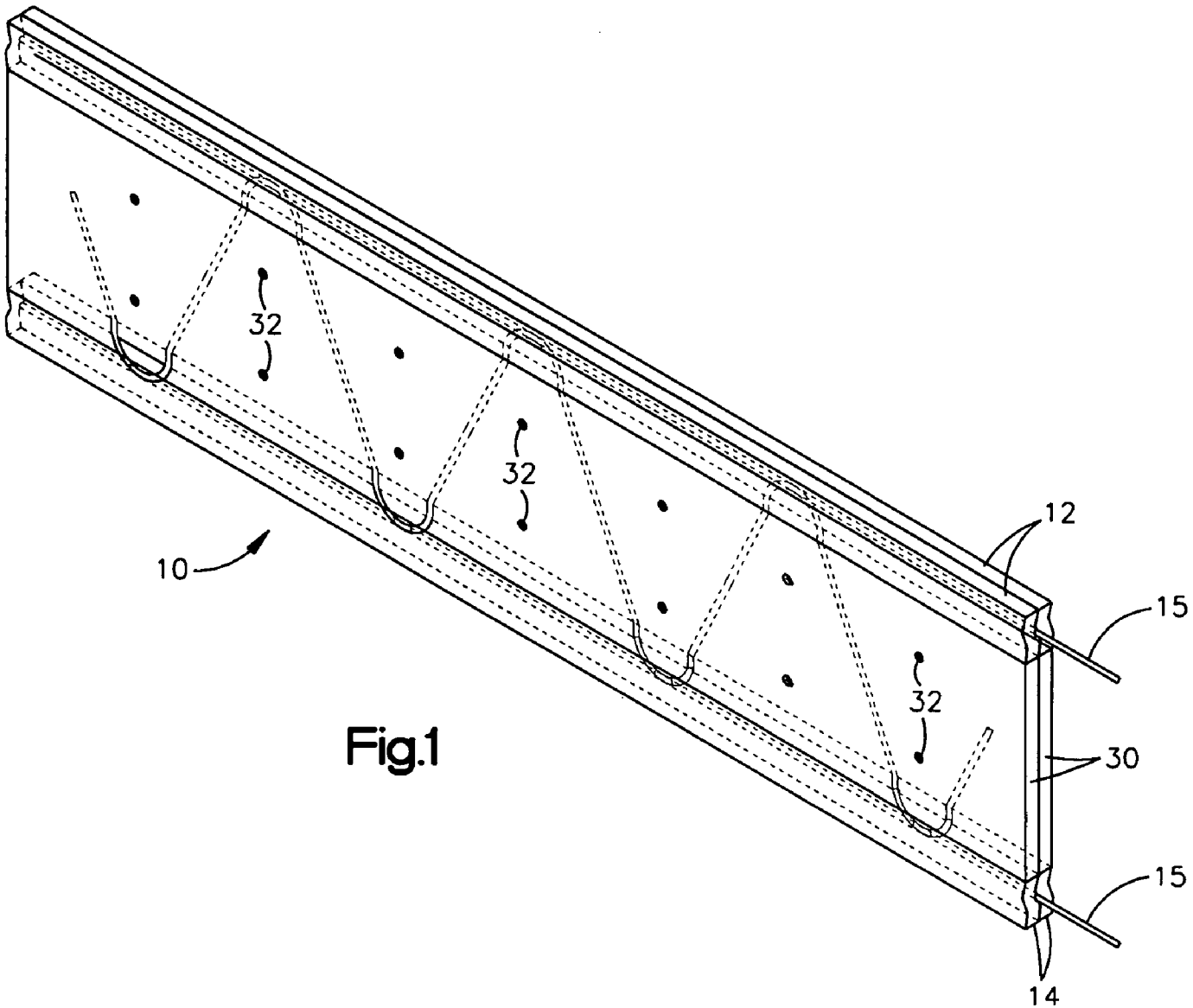
FIG. 1 is a perspective view of a section of a completed composite beam made in accordance with the present Invention.
Figure 2:
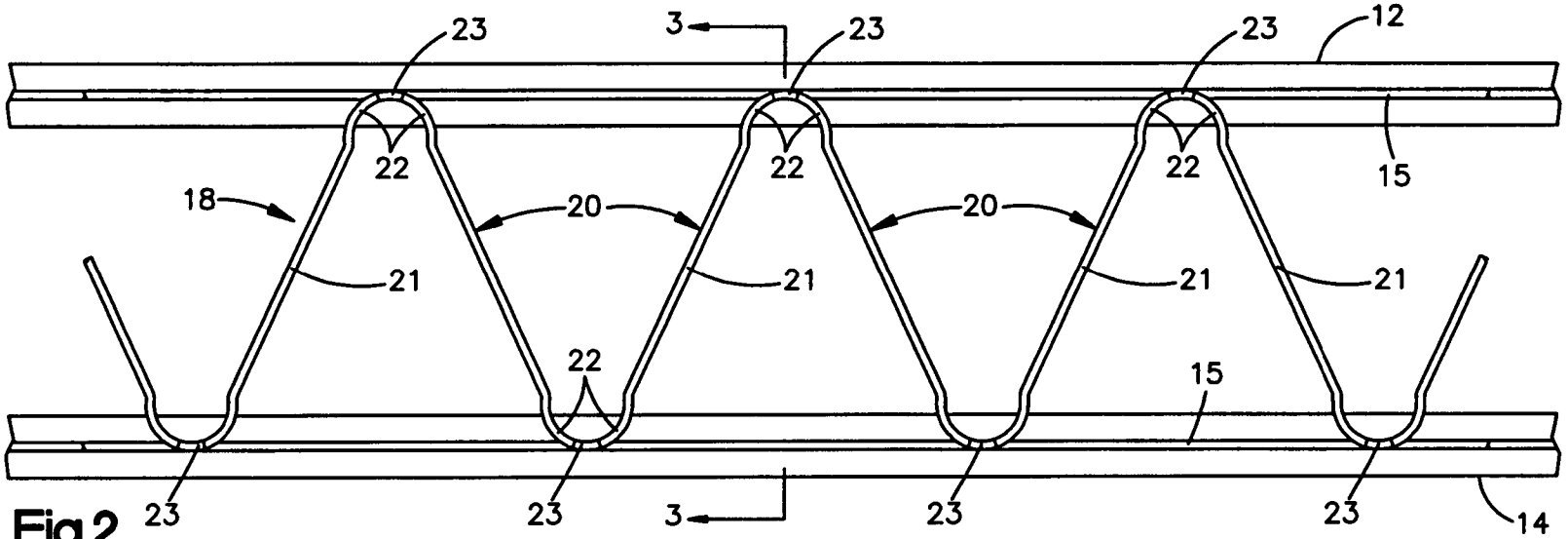
FIG. 2 is an elevational view of a section of a partially formed beam as seen from the plane indicated by the line 2—2 of FIG. 3 A.

Referring now to the drawings and to FIG. 1 in particular a composite beam made in accordance with the present invention is shown generally at 10. The beam includes upper and lower pairs of elongate wood members 12,14.

A steel reinforcement is provided. The reenforcement includes upper and lower, elongate, straight rods 15. One of each elongate member pair 12,14 includes an elongated groove 16 shaped to receive and house an associated one of the rods 15. The reenforcement also includes a sinuous assembly 18. The sinuous assembly is composed of serpentine rods or sections 20 each consisting of a straight central part 21 and spaced arcuately curved end parts or spacer portions 22.

The sections 20 are alternately oppositely oriented with the end parts 22 abutting to define arcuately curved junctures. The spaced arcuately curved end parts 22 define a space or gap 23 between the end parts 22 at the arcuately curved junctures. Each abutting pair of end parts 22 is welded together and to an adjacent one of the elongate rods 15 at the accurately curved junctures to complete a reenforcing sinuous assembly.

As is best seen in FIG. 4, the other elongate member of the pairs 12,14, has spaced arcuate grooves 28. Preferably the grooves 28, like the grooves 16 are formed with a router. Each arcuate groove 28 receives an associated one of the end part junctures. When the member pairs 12,14 are brought into face to face abutment to complete a beam, the member pairs hide both the elongate rods and the junctures.

To complete the beam as shown in FIG. 1, a pair of side panels 30 are positioned on opposite sides of the sinuous assembly, as shown in FIG. 5. The panels 30 are fixed together by suitable fasteners such as screws 32. Outer surfaces of the panels 30 are preferably aligned with outer faces of the elongate members 12,14. As is best seen in FIG. 3B, the side panels are preferably of different thickness in order to abut both sides of the sinuous assembly 18.

The novel and improved beam has the advantages of strength of a composite beam, small components which are less expensive and more readably available than solid wood beam while providing the appearance and workable characteristics of an all wood beam such as for receiving nails and screws and being worked by such procedures as chiseling and drilling.

While the prior description of the preferred embodiment has focused on a beam, a composite truss employing the same inventive concepts and construction differs essentially only in the sizes of the components and the truss.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and scope of the invention as hereinafter claimed.

What I claim is:

1. A composite building component comprising:

a. spaced pairs of elongate members, the members of each pair being in face to face contacting orientation;

b. a generally sinuous shaped spacer rod sub assembly having a plurality of spacer portions connected at junctures;

c. the elongate member pairs each having mating faces including recesses each contoured to receive one of the junctures and parts of connected spacer portions, the connected spacer portions projecting angularly in opposed directions from their associated juncture and its recess in one of the pairs toward the other pair of members; and, d. each of the junctures being disposed in an associated recess whereby to provide a composite component having the pairs of elongate members maintained in spaced relationship by the rod subassembly.

2. The component of claim 1 wherein the rod junctures in the recesses of the one pair are interconnected by an elongate rod.

3. The component of claim 2 wherein the recesses of the one pair are in a first of the pair and the other of said one pair includes an elongate recesses receiving the elongate rod.

4. The component of claim 2 wherein the junctures in the recesses of the other pair of members are interconnected by another elongate rod.

5. The component of claim 4 wherein the recesses of the other pair of members are in a first of the other pair and the other member of the other pair includes an elongate recess receiving said another elongate rod.

6. A composite building component comprising:

a. a spaced pair of elongate rods, b. a plurality of serpentine rods each rod having two spaced sets of junctures;

c. the junctures of one set being fused to one of the elongate rods and the junctures of the other set being fused to the other of the elongate rods;

d. spaced pairs of elongate wood members with the members of each pair being in face to face contacting relationship;

e. one member of each wood pair having an elongate groove in its face sized to receive an associated one of the elongate rods;

f. the other member of each wood pair having spaced contoured recesses each housing an associated one of the junctures whereby the serpentine rods and junctures are each disposed between the members of an associated one of the wood pairs; and, g. at least two composite members disposed between the elongate wood members covering a portion of said serpentine rods and on opposite sides of the serpentine rods whereby to provide a composite component strengthened by metal rods while having the appearance of a wood structure.

7. The component of claim 6 wherein the rods are steel and the fusing of the rods is by welds.

8. The component of claim 6 wherein the composite members are wood composites.

9. The component of claim 6 wherein the composite members are plywood.

10. The component of claim 6 wherein sections of the serpentine rods between the junctures are straight.

11. The component of claim 6 wherein the serpentine rod is comprised of a plurality of parts each having a straight central portion and curved ends, each curved end being joined to a like curved end of another part to form one of the junctures.

12. A process of making a composite building component comprising:

a. forming a metal reenforcement by connecting a plurality of sinusoidal section sections to a spaced pair of reenforcing rods;

b. forming grooves in each of two pairs of elongate wood members with the grooves being shaped to receive top and bottom portions of the reenforcement;

c. bring the members of each pair into face to face engagement with one of the pairs encasing the top portion and the other of the pairs encasing the bottom portion; and, d. securing a pair of wood side panels in facing spaced relationship between the member pairs and on opposite sides of a central portion of the reenforcement whereby to provide a composite component with the reenforcement circumferentially encased in wood to provide the appearance and workability of a wood component.

13. The component of claim 1, wherein two composite members on opposite sides of the sinuous shaped spacer rod sub assembly, and cover a portion of said sinuous shaped spacer rod sub assembly.

14. The component of claim 13, wherein said composite members are of varying thicknesses.

15. The component of claim 13, wherein said composite members cover the entire sinuous shaped spacer rod sub assembly.

16. The component of claim 13, wherein said composite members extend to the circumference of said elongate members.

17. The component of claim 13, wherein said composite members are disposed between said elongate members.

18. The composite building component of claim 6, wherein said composite members are of varying thickness.

19. The composite building component of claim 6, wherein said composite members cover a portion of said elongate wood members.

20. The composite building component of claim 10, wherein said composite members enclose the serpentine rods.

21. The composite building component of claim 6, wherein said composite members cover the perimeter of said elongate wood members.

22. The process of making a composite building component of claim 12, wherein said wood side panels provide a composite component with reenforcement partially encased in wood.

23. The component of claim 1, wherein said spacer portions include a gap between said spacer portions at their associated juncture.

24. The component of claim 1, wherein said spacer portions include arcuately curved end parts.

25. The component of claim 2, wherein said spacer portions include a gap between said spacer portions at their associated juncture for fusing said spacer portions to said elongate rod.

26. The component of claim 25, wherein the spacer portions and said elongate rod are steel and said fusing of said rods is by welds.

27. The component of claim 1, wherein said recesses are arcuate.

28. The component of claim 6, wherein spaced contoured recesses are arcuate.

29. The component of claim 6, wherein said spaced set of junctures includes a gap for welding said elongate rods to said serpentine rods.

30. The component of claim 6, wherein said plurality of serpentine rods each comprise a straight portion having two directionally opposed semi-arcuate ends.

31. A composite beam comprising:

a. a spaced first and second of elongate rods;

b. a plurality of serpentine rods having a straight portion and opposing first and second arcuate ends;

c. a plurality of spaced junctures are formed by alternating said opposing first and second arcuate ends along said spaced first and second elongate rods;

d. a spaced pair of elongate wood members with the members of each pair being in face to face contacting relationship;

e. one member of each elongate wood member pair having an elongate groove in its face sized to receive an associated one of the elongate rods;

f. the other member of each elongate wood member pair having spaced arcuate recesses each housing an associated one of the junctures whereby, the serpentine rods and junctures are each disposed between the members of an associated one of the wood pairs; and, g. at least two composite members disposed between the elongate wood members covering a portion of said serpentine rods and on opposite sides of the serpentine rods whereby to provide a composite component strengthened by metal rods while having the appearance of a wood structure.

32. The composite beam of claim 31, wherein the junctures of said serpentine rods are welded to said elongate rods.

* * * * *